US009663988B2

(12) United States Patent
Merker et al.

(10) Patent No.: US 9,663,988 B2
(45) Date of Patent: May 30, 2017

(54) HOLD DOWN DEVICE FOR WINDOW COVERING LOOPED OPERATOR

(71) Applicant: Springs Window Fashions, LLC, Middleton, WI (US)

(72) Inventors: Thomas H. Merker, Janesville, WI (US); Michael A. Graybar, Madison, WI (US); Phillip R. Harms, Belleville, WI (US)

(73) Assignee: SPRINGS WINDOW FASHIONS, LLC, Middleton, WI (US)

( * ) Notice: Subject to any disclaimer, the term of this patent is extended or adjusted under 35 U.S.C. 154(b) by 128 days.

(21) Appl. No.: 14/478,956

(22) Filed: Sep. 5, 2014

(65) Prior Publication Data

US 2014/0373311 A1 Dec. 25, 2014

Related U.S. Application Data

(63) Continuation of application No. PCT/US2013/029634, filed on Mar. 7, 2013.

(60) Provisional application No. 61/607,847, filed on Mar. 7, 2012.

(51) Int. Cl.
*E06B 9/325* (2006.01)
*E06B 9/324* (2006.01)

(52) U.S. Cl.
CPC ..... *E06B 9/325* (2013.01); *E06B 9/324* (2013.01); *Y10T 24/3904* (2015.01); *Y10T 24/3936* (2015.01); *Y10T 24/3984* (2015.01)

(58) Field of Classification Search
CPC ..... E06B 9/325; E06B 9/324; E06B 9/326; E06B 2009/3265; Y10T 24/3936; Y10T 24/3904; Y10T 24/3984; Y10T 24/39; Y10T 24/3916; Y10T 24/3989; Y10T 24/44752; F16G 11/10; F16G 11/101
See application file for complete search history.

(56) References Cited

U.S. PATENT DOCUMENTS

| | | | | |
|---|---|---|---|---|
| 2,554,303 A * | 5/1951 | Longhenrich | A44B 15/00 24/116 A |
| 5,163,492 A | 11/1992 | Remington et al. | |
| 5,193,252 A * | 3/1993 | Svehaug | E04H 15/32 24/115 G |
| 5,562,140 A | 10/1996 | Biba | |
| 5,592,983 A | 1/1997 | Sartini et al. | |
| 6,085,824 A | 7/2000 | Cadorette | |
| 6,305,053 B1 * | 10/2001 | Galbreath | F16G 11/10 24/115 G |

(Continued)

OTHER PUBLICATIONS

Notification Concerning Transmittal of International Preliminary Report on Patentability dated Sep. 18, 2014 for International Application No. PCT/US2013/029634 (6 pages).

*Primary Examiner* — Robert J Sandy
*Assistant Examiner* — Matthew Sullivan
(74) *Attorney, Agent, or Firm* — Michael Best & Friedrich LLP

(57) ABSTRACT

A hold down device is provided for continuous loop cords or bead chains in a window covering installation. The hold down device engages the cord or chain while the cord or chain is loosely suspended, and prevents operation by encountering the head rail if the cord or chain is operated. Mounting the hold down device in a window covering installation disengages the hold down device from its secured position relative to the cord or chain.

23 Claims, 10 Drawing Sheets

(56) References Cited

U.S. PATENT DOCUMENTS

| | | | | |
|---|---|---|---|---|
| 7,841,376 | B2 * | 11/2010 | Lin | E06B 9/32 160/168.1 R |
| 8,695,174 | B1 * | 4/2014 | Cheng | E06B 9/324 160/178.1 R |
| 2001/0010110 | A1 * | 8/2001 | Matsushima | A44B 13/007 24/130 |
| 2006/0196995 | A1 * | 9/2006 | Mori | A47B 21/06 248/74.2 |
| 2007/0157438 | A1 * | 7/2007 | Judd | B65H 75/36 24/115 R |
| 2010/0219311 | A1 * | 9/2010 | Ng | E06B 9/324 248/222.14 |
| 2011/0036517 | A1 | 2/2011 | Chen | |
| 2012/0000036 | A1 * | 1/2012 | Wen | E06B 9/326 24/115 F |

* cited by examiner

HOLD DOWN DEVICE FOR WINDOW COVERING LOOPED OPERATOR

CROSS-REFERENCE TO RELATED APPLICATIONS

The present application claims the benefits of, and priority to U.S. Provisional Application Ser. No. 61/607,847, entitled "HOLD DOWN DEVICE FOR WINDOW COVERING LOOPED OPERATOR", filed Mar. 7, 2012, and PCT International Patent Application Serial No. PCT/US2013/029634, entitled "HOLD DOWN DEVICE FOR WINDOW COVERING LOOPED OPERATOR", filed Mar. 7, 2013, both of which are incorporated herein by reference.

FIELD OF THE INVENTION

The present invention generally relates to window coverings that use continuous loop operators such as cords and chains, and, more specifically, to hold down devices that are used with such window coverings for securing the remote end of the looped operator, whether the operator is a cord or beaded chain.

BACKGROUND OF THE INVENTION

Some types of window coverings use a continuous loop operator for opening and closing the window covering or for causing other adjustments of the window covering. Horizontal blinds, Roman shades and other window coverings can be operated with a continuous loop cord or a continuous loop beaded chain that is rotated through operating mechanism in the head rail to cause the desired adjustment of the window treatment. Such continuous loop operators are well known in the industry, having had application and use for many years.

It is known to use a chain or cord hold down device to control the continuous loop operator of a shade or blind. Uncontrolled continuous loop operators can be unsightly, difficult to use and can pose certain risks. The hold down device is secured to the floor, wall or window frame and captures the remote end of the continuous loop operator, thereby holding the operator substantially flat against the window frame or wall, and keeping the continuous loop operator relatively taut. In the past, the hold down devices have been open, allowing the cord to run freely their through even if the hold down device is not properly mounted or secured to the floor, wall or window frame. More recently, it is known to use hold down devices that securely grasp the cord or chain when not installed, thereby significantly minimizing the distance through which the looped operator can be moved without properly securing the hold down device. The cord or chain will operate only until the hold down device secured thereto advances to and lodges against the head rail.

Many different designs are known whereby the hold down device is loosened from the cord or bead chain automatically as the hold down device is installed in a proper manner. Springs and crimping mechanisms are known for use in such devices; however, the overall mechanisms therefor can be relatively complex. With numerous parts requiring assembly and significant manufacturing time required, known hold down devices have been expensive to manufacture and assemble. Some are difficult to install, and some are easily defeated whereby the hold down device can be loosened from the cord even when the hold down device is not properly installed. For some, installation can be quite difficult for one installer alone, and installing the hold down device as a retrofit in a pre-existing installation can be difficult.

To encourage proper use of the hold down device, it is desirable to have a hold down device that can capture a cord or beaded chain securely, and that is not easily defeated. However, the device should be relatively easy to install by an untrained individual. Further, a device easily installed as a retrofit of a continuous loop operator is desirable. Providing the hold down device as a simple construction not requiring assembly of the device itself, only installation on the cord or chain, reduces cost and provides further advantages.

SUMMARY OF THE INVENTION

The hold down device disclosed herein is formed as a monolithic body of suitable injection molded plastic material and utilizes the natural springiness of the material to effect grasping of the cord or chain. A basic clamshell type structure is used whereby the cord or chain is grasped securely by the device when the device is spread wide in its natural, relaxed state, and that can be secured with the two halves closed against one another and the cord or chain loosened therefrom for relatively free operation there through.

In one aspect of a form thereof, the hold down device is easy to install on the continuous loop operator and easy to mount within the window covering installation by a single individual with minimal skills.

In another aspect of a form thereof, the hold down device engages a cord or bead chain securely and naturally, and cannot be defeated easily without properly installing the hold down device within the window covering installation.

In another aspect of a form thereof, the hold down device is provided as a monolithic body of injection molded plastic that is manufactured easily, simply and inexpensively.

Other features and advantages of the invention will become apparent to those skilled in the art upon review of the following detailed description, claims and drawings in which like numerals are used to designate like features.

Figure 1:
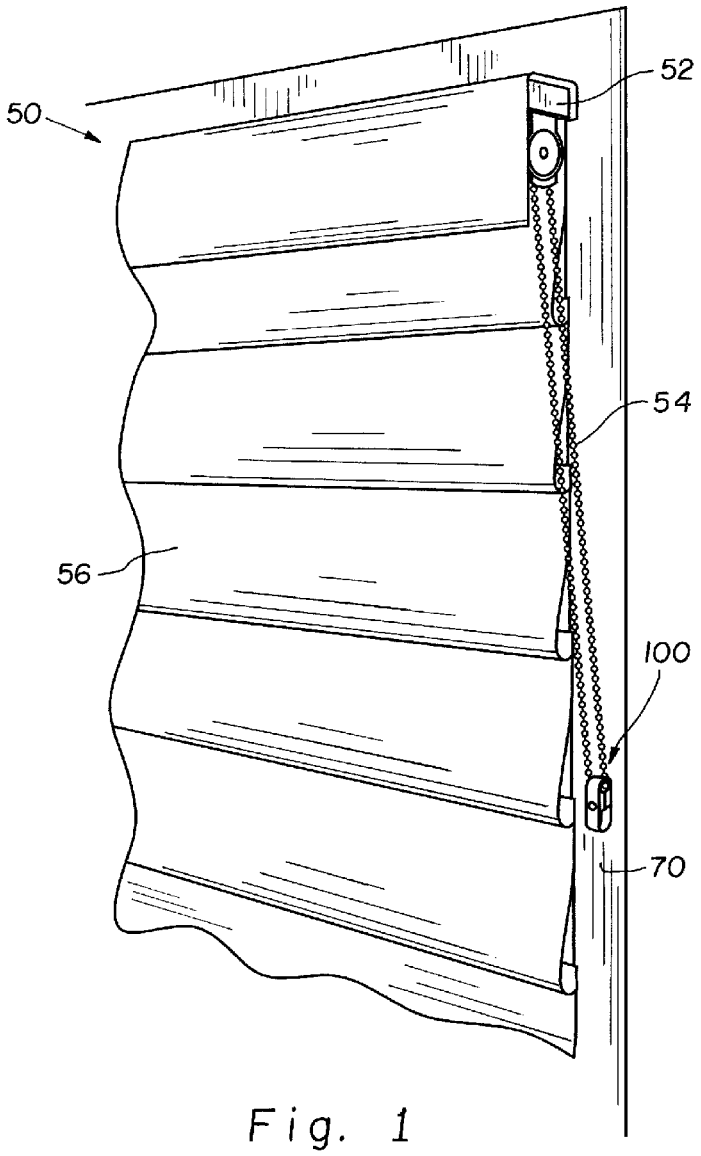
FIG. 1 is a perspective view of a window covering installation using a hold down device according to a first embodiment.
Figure 2:
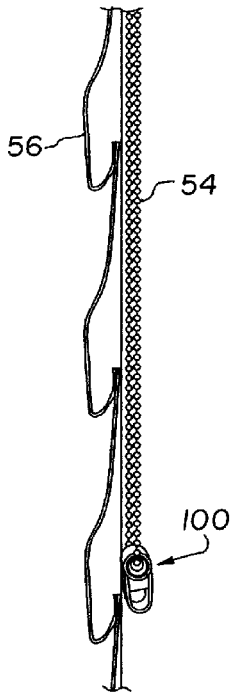
FIG. 2 is a side elevational view of the window covering installation shown in FIG. 1.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Referring now more particularly to the drawings and to FIG. 1 in particular, a window covering installation 50 is shown, which includes a hold down device 100. Window covering installation 50 further includes a head rail 52 and a continuous loop operator 54 provided as a continuous loop bead chain. Rotation of bead chain continuous loop operator 54 operates mechanisms in head rail 52 for lifting and lowering a window shade panel 56. While a Roman shade panel 56 is illustrated, it should be understood that the hold down device disclosed herein can be used with looped operators supplied on various types of window coverings. The Roman shade depicted herein is merely one example of a well-known structure for which the hold down device is suitable.

Figure 3:
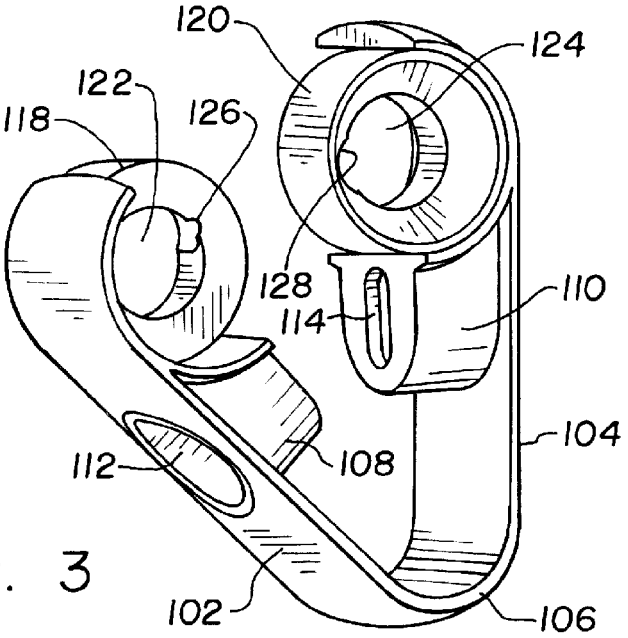
FIG. 3 is a perspective view of the first embodiment for a hold down device suitable for use on a continuous loop bead chain operator.
Figure 6:
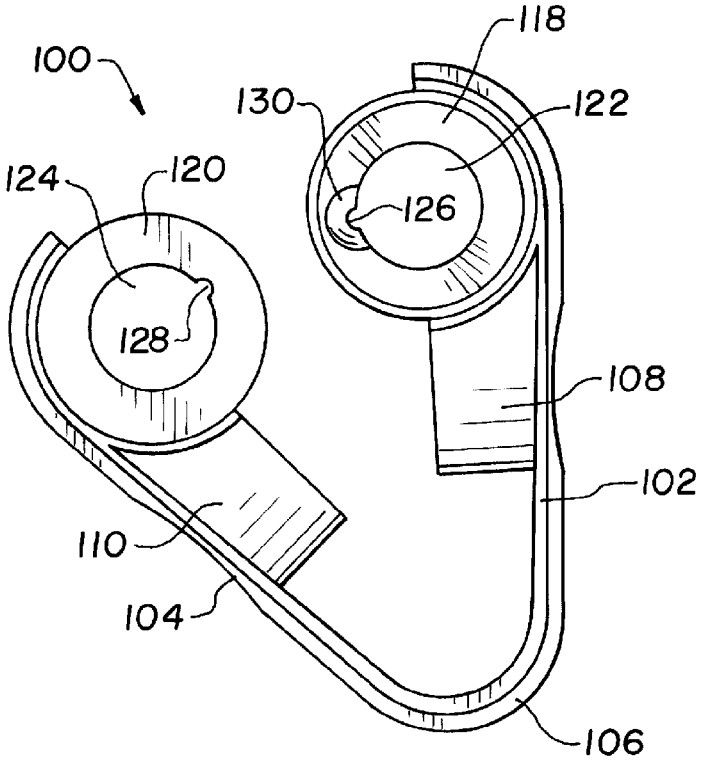
FIG. 6 is an elevational view of the hold down device shown in the previous views, and shown from an angle to illustrate the side opposite the side shown in FIG. 3.
Figure 7:
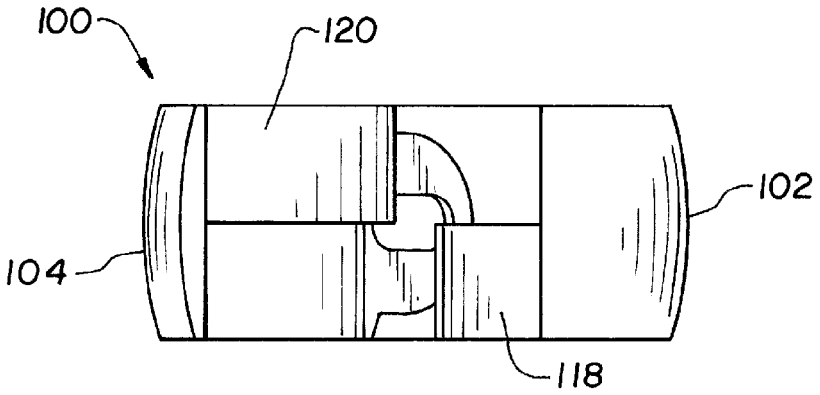
FIG. 7 is a top view of the hold down device in an open, uninstalled condition.
Figure 8:
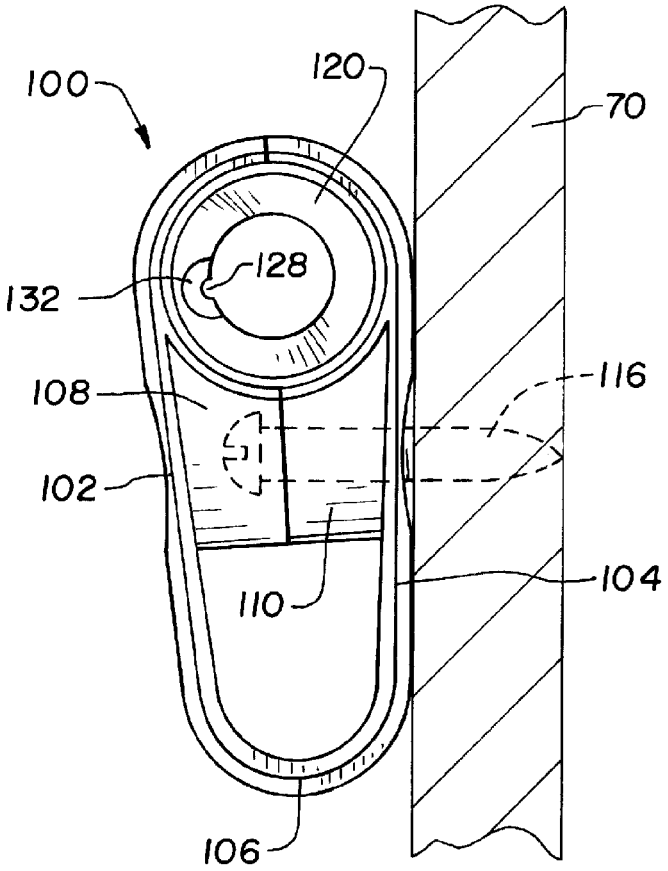
FIG. 8 is a side elevational view of the hold down device in an installed condition, but without the chain being illustrated for clarity.
Figure 9:
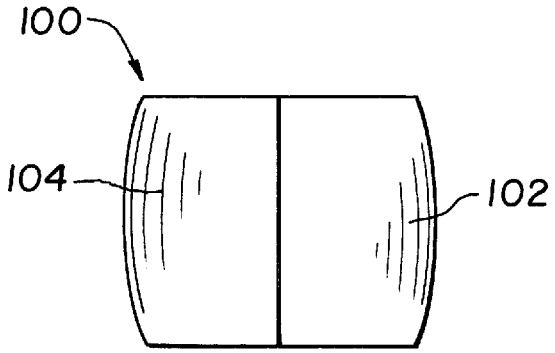
FIG. 9 is a top view similar to that of FIG. 7, but illustrating the hold down device in the installed condition as shown in FIG. 8.

Hold down device 100 has a generally overall clamshell or V-shaped configuration including first and second arms 102, 104 interconnected by an integral connecting web 106. Hold down device 100 is made of molded plastic that is rigid and firm, yet yielding for providing spring-like characteristics in connecting web 106 such that, in a relaxed state of hold down device 100, arms 102, 104 are remote from one another as depicted in FIGS. 3 & 6, but can be pushed toward one another for mounting as depicted in FIG. 8.

Arms 102, 104 include confronting mounting blocks 108, 110 on the inwardly facing surfaces of arms 102, 104 respectively. Mounting blocks 108, 110 are positioned to be aligned with one another when the hold down device is fully mounted and installed within window covering installation 50. Mounting blocks 108, 110 define holes 112, 114, respectively, for receiving a mounting screw 116 for the final mounting of hold down device 100 within window covering installation 50, as will be described subsequently herein.

Arms 102, 104 further include offset heads 118, 120, respectively, also on the inwardly facing surfaces of arms 102, 104 at the distal ends of arms 102, 104. Heads 118, 120 are offset relative to one another, to slide past one another and overlie one another in the final mounting depicted in FIG. 8. Heads 118, 120 define apertures 122, 124 there through transverse to the directions that arms 102, 104 move toward one another. Apertures 122, 124 further define notches 126, 128, respectively, along the perimeters thereof. Notches 126, 128 are located along the inward edge portions of apertures 122, 124 in regions of the perimeters of apertures 122, 124 that are near one another in the relaxed condition of hold down device 100. Notches 126, 128 are positioned within depressions 130, 132 surrounding the notches.

Figure 4:
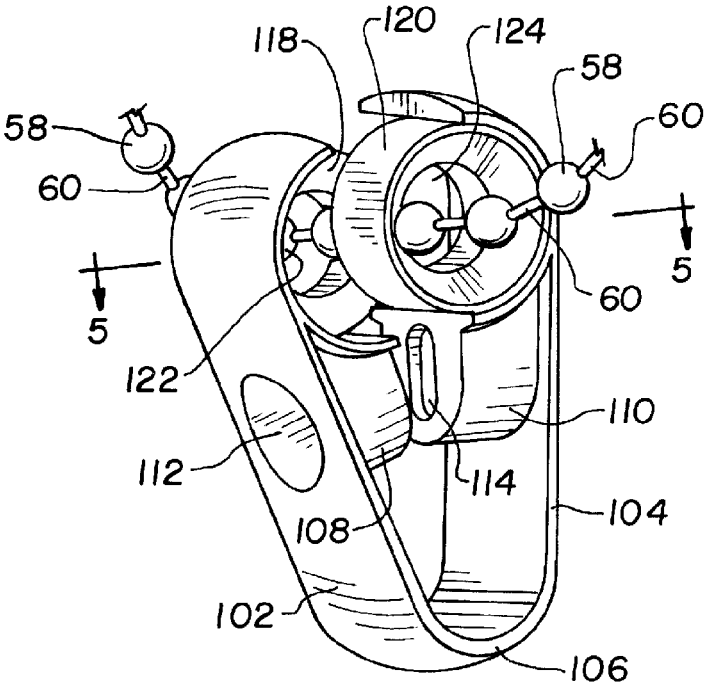
FIG. 4 is a perspective view of the hold down device shown in FIG. 3, illustrating the hold down device installed on a bead chain.
Figure 5:
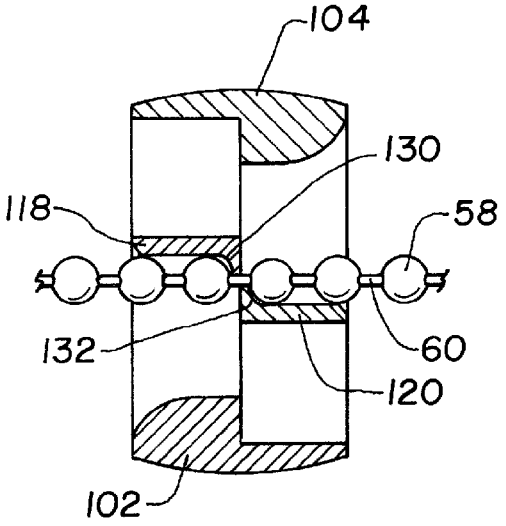
FIG. 5 is a cross-sectional view of the hold down device and bead chain shown in FIG. 4, taken along line 5-5 of FIG. 4.

Bead chain continuous loop operator 54 is a common configuration, well-known to those skilled in the art, and includes beads 58 connected in a continuous strand by links 60. Bead chain continuous loop operator 54 further includes a connector of well-known configuration by which an elongated strand of interconnected beads 58 and links 60 can be connected end to end to form a continuous loop bead chain. Accordingly, the continuous loop can be disconnected such that bead chain continuous loop operator 54 can be threaded through apertures 122, 124 as depicted in FIG. 4. The springiness of connecting web 106 urges arms 102, 104 outwardly such that hold down device 100 in its relaxed state engages continuous loop operator 54 via notches 126, 128 receiving a link 60 therein, with adjacent beads 58 on opposite sides thereof held within depressions 130, 132. Hold down device 100 thereby securely captures bead chain continuous loop operator 54 and is not easily dislodged there from. Hold down device 100 renders the shady inoperable in that continuous loop operator 54 can be advanced only until hold down device 100 encounters head rail 52 until such time as hold down device 100 is properly mounted within window covering installation 50.

Hold down device 100 is mounted in window covering installation 50 after head rail 52 is installed in the window opening. Arms 102, 104 are urged toward one another so that mounting blocks 108, 110 engage one against the other. Heads 118, 120 slide past one another such that the heads overlie one another and apertures 122, 124 align. Mounting screw 116 is inserted through aligned holes 112, 114 and secured within a base 70 that can be a portion of a window frame on which window covering installation 50 is installed, a wall adjacent the window or some suitable structure nearby. Fastening screw 116 to base 70, with screw 116 inserted from the outside arm 102, 104 through the inside arm 102, 104 draws the arms together and against base 70. Blocks 108, 110 are drawn against one another when heads 118, 120 are positioned adjacent one another, and apertures 122, 124 align. In this position, which may be considered a "closed" position of hold down device 100, notches 126, 128 are no longer exposed, each being covered along one side by solid portions of the now adjacent head 118 or head 120. Accordingly, bead chain continuous operator 54 can slide freely through aligned apertures 122, 124 without catching on notches 126, 128. The position at which hold down device 100 is mounted is such as to hold bead chain continuous loop operator 54 in a relatively taut condition. With hold down device 100 thus installed, apertures 122, 124 aligned one with the other and notches 126, 128 no longer exposed, bead chain continuous loop operator 54 can rotate freely through hold down device 100 for adjusting shade panel 56 by operating apparatus within head rail 52 well known to those skilled in the art.

Figure 10:
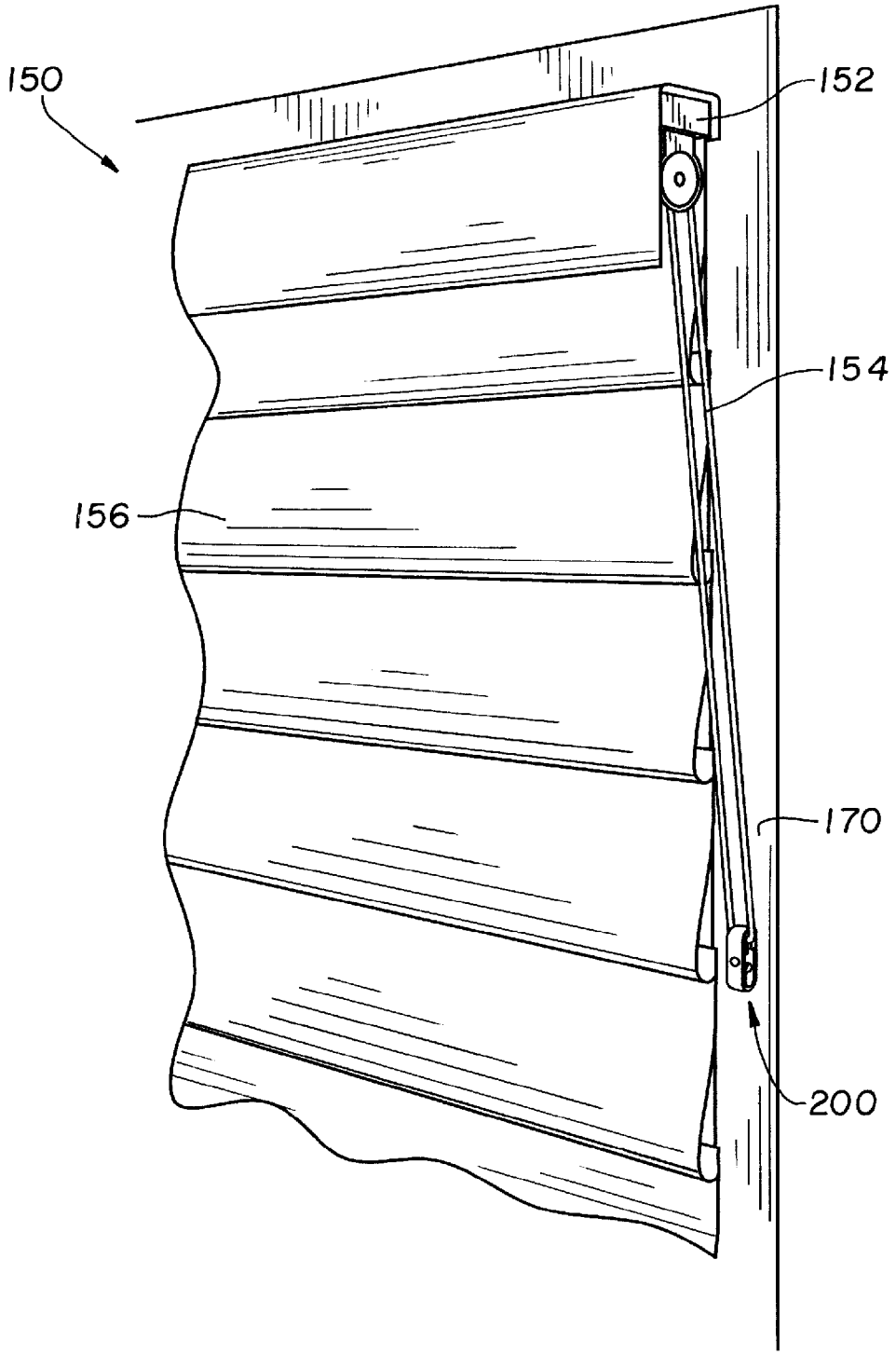
FIG. 10 is a perspective view of a window covering installation using a hold down device according to a second embodiment.
Figure 12:
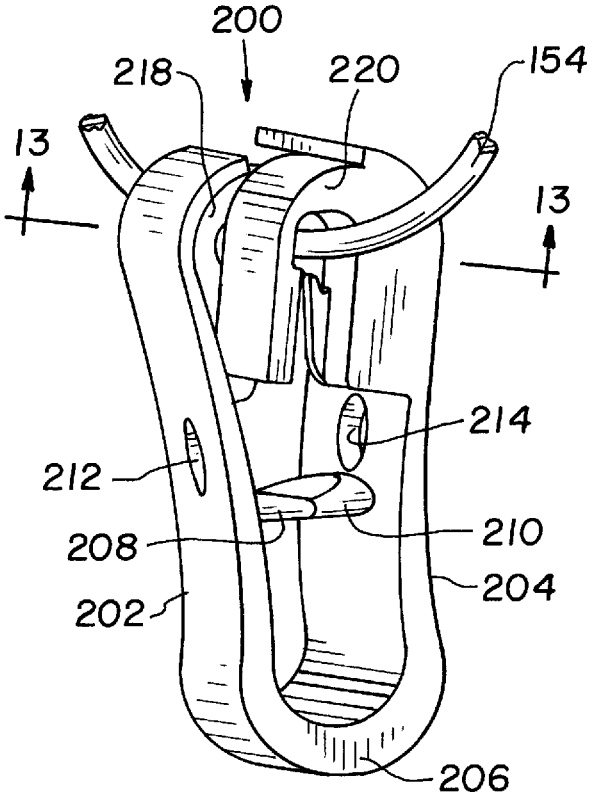
FIG. 12 is a perspective view of the hold down device shown in FIG. 11, illustrating the hold down device installed on a cord.
Figure 13:
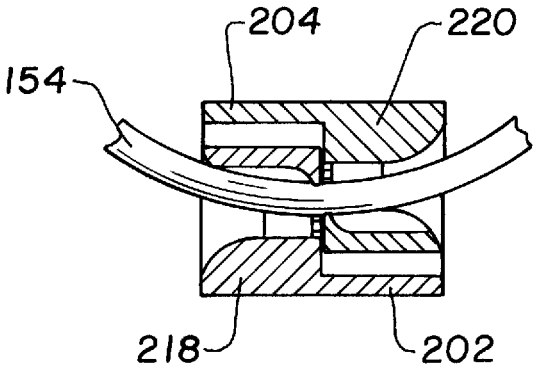
FIG. 13 is a cross-sectional view of the hold down device and cord shown in FIG. 12, taken along line 13-13 of FIG. 12.

A hold down device also can be provided suitable for use with a cord instead of a bead chain used as the continuous operator in a window covering. FIG. 10 depicts a window covering installation 150, which includes a hold down device 200. Window covering installation 150 further includes a head rail 152 and a continuous loop operator 154 provided as a continuous loop cord. Rotation of cord continuous loop operator 154 operates mechanism in head rail 152 for lifting and lowering a window shade panel 156 by way of mechanisms in head rail 152 well known to those skilled in the art. While a Roman shade panel 156 is illustrated, it should be understood that the hold down device disclosed herein can be used with looped operators supplied on various types of window coverings. The Roman shade depicted is merely one example of a well-known structure that is suitable.

Figure 11:
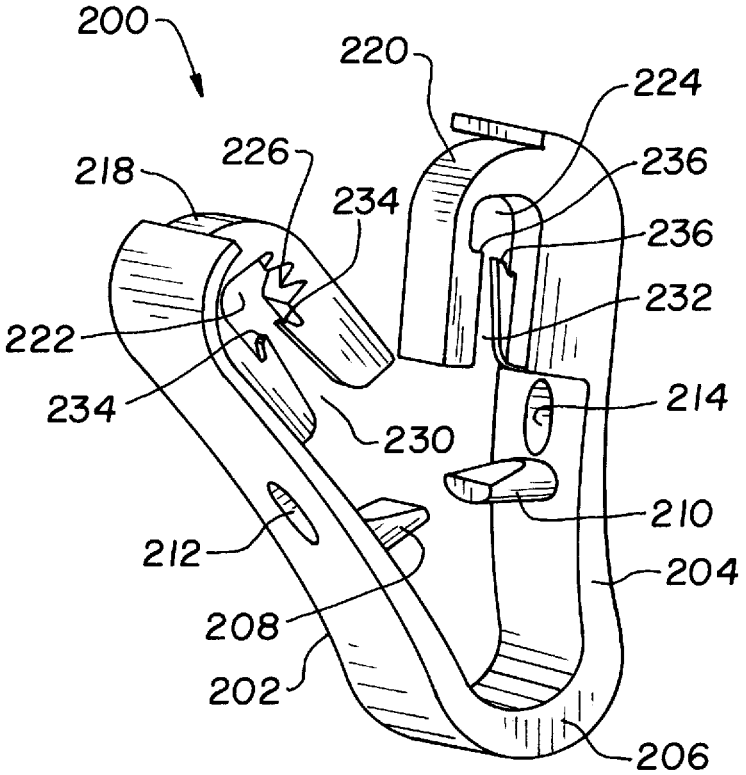
FIG. 11 is a perspective view of the second embodiment for a hold down device suitable for use on a continuous loop cord.
Figure 14:
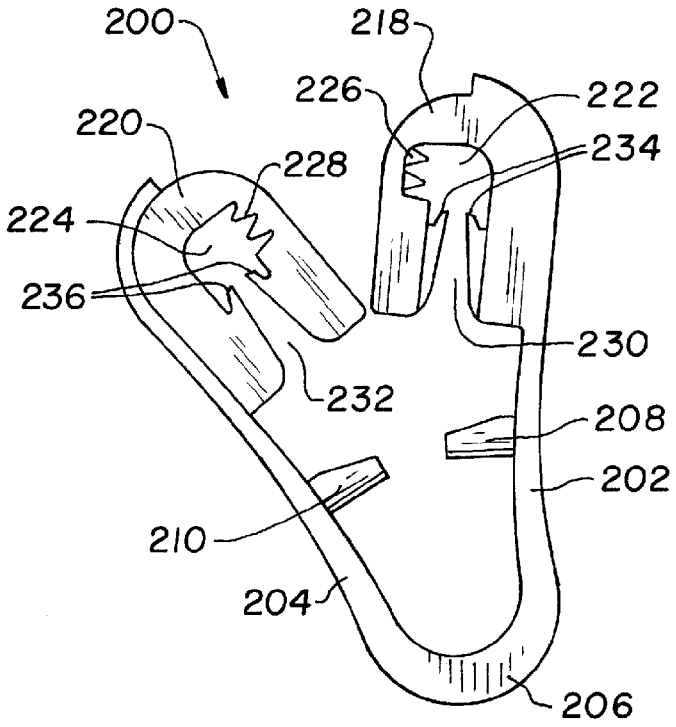
FIG. 14 is an elevational view of the hold down device according to the second embodiment, and shown from an angle to illustrate the side opposite the side shown in FIG. 11.
Figure 15:
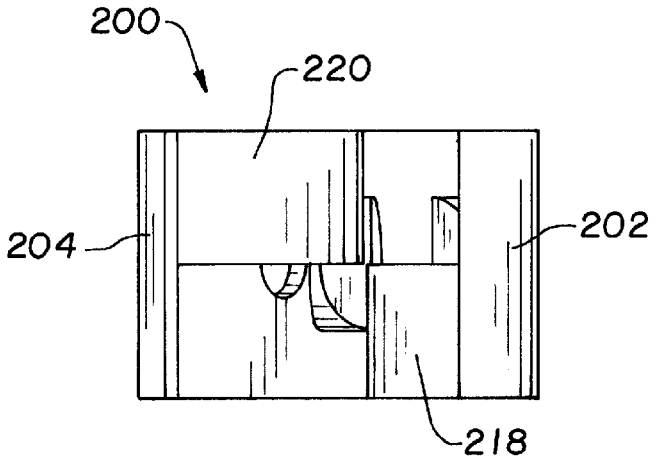
FIG. 15 is a top view of the hold down device according to the second embodiment, the device being shown in an open, uninstalled condition.
Figure 16:
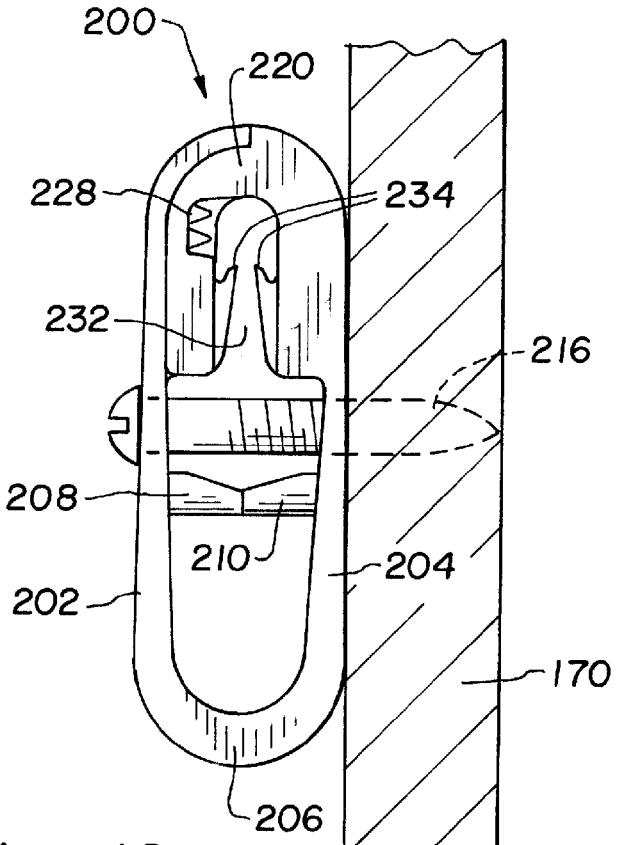
FIG. 16 is a side elevational view of the hold down device according to the second embodiment shown in an installed condition, but without the cord being illustrated for clarity.
Figure 17:
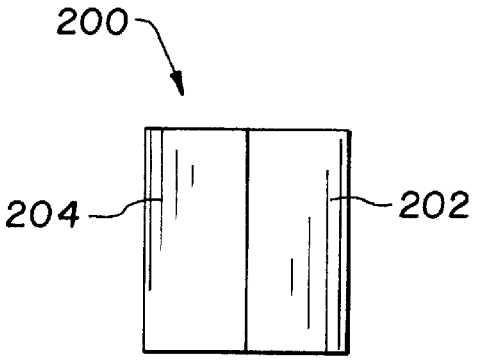
FIG. 17 is a top view similar to that of FIG. 15, but illustrating the hold down device in the installed condition shown in FIG. 16.

Hold down device 200 has a generally overall clamshell or V-shaped configuration including first and second arms 202, 204 interconnected by an integral connecting web 206. Hold down device 200 is made of molded plastic that is rigid and firm, yet yielding for providing spring-like characteristics in connecting web 206 such that, in a relaxed state, arms 202, 204 are remote from one another as depicted in FIGS. 11 & 14, but can be pushed toward one another for mounting as depicted in FIG. 16.

Arms 202, 204 include confronting mounting blocks 208, 210 respectively that are positioned to abut one against the other when hold down device 200 is in its mounted condition. Mounting blocks 208, 210 are provided on the inwardly facing surfaces of arms 202, 204. Arms 202, 204 also define holes 212, 214 there through, respectively, for receiving a mounting screw 216. Arms 202, 204 further include offset heads 218, 220, respectively, on the inwardly facing surfaces, at the distal ends thereof. Heads 218, 220 slide past one another so as to overlie one another in the final installation depicted in FIG. 16. Heads 218, 220 define apertures 222, 224 there through, transverse to the direction of movement of arms 202, 204 toward one another. Apertures 222, 224 further define inwardly facing serrated portions 226, 228, respectively, along the perimeters thereof. Serrated portions 226, 228 are positioned in regions of the perimeters of apertures 222, 224 that are near one another in the relaxed condition of hold down device 200.

Cord continuous loop operator 154 is of a common configuration, such as a braided cotton cord. Cord continuous loop operator 154 does not need to be disassembled, cut or otherwise disrupted to install hold down device 200 thereon. One-way channels 230, 232 are provided from the perimeters of heads 218, 220 through to apertures 222, 224 in heads 218, 220. One-way channels 230, 232 are wider at the outer ends thereof and narrower at the inner ends thereof than the diameter of cord continuous loop operator 154. The innermost ends of one-way channels 230, 232 are provided with pairs of inwardly angled projections into apertures 222, 224; including projections 234 at opposite sides of one-way channel 230 and projections 236 at opposite sides of one-way channel 232. Accordingly, cord continuous loop operator 154 passes easily from outside apertures 222, 224 to inside apertures 222, 224 by compressing the cord in the progressively narrowing channel, and/or by deflecting inwardly angled projections 234, 236. However, moving continuous cord operator 154 from inside apertures 222, 224 is obstructed first by the inwardly angled projections 234, 236, and thereafter by the narrow ends of channels 230, 232.

Figure 18:
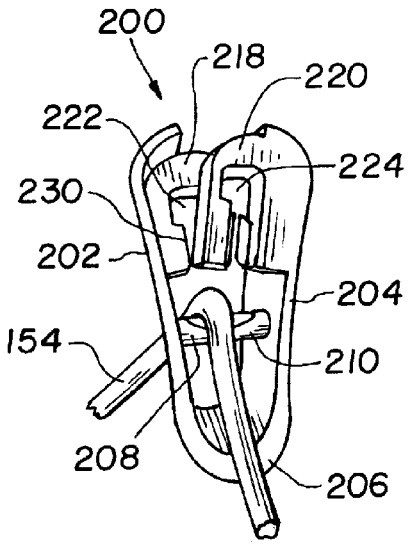
FIGS. 18, 19 & 20 are sequential illustrations showing the manner in which the hold down device according to the second embodiment can be installed as a retrofit upgrade on a pre-existing, continuous loop cord installation.
Figure 20:
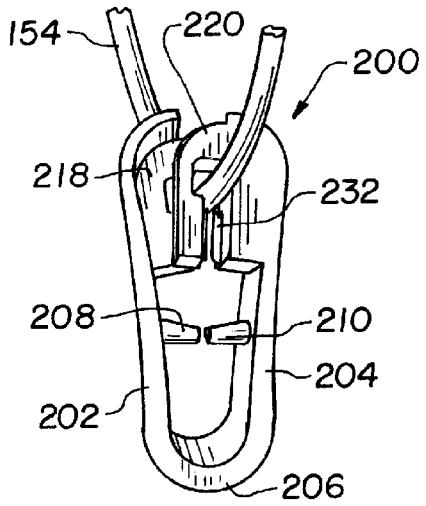
Figure 19:
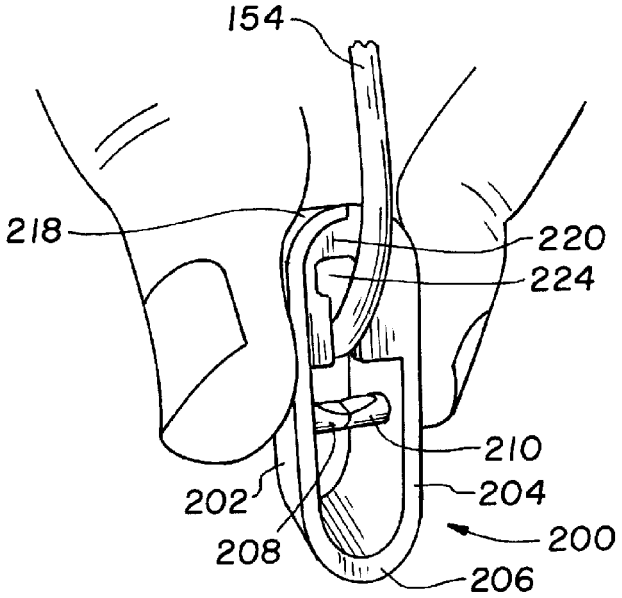

Hold down device 200 is installed on cord continuous loop operator 154 as shown in FIGS. 18, 19 & 20. With arms 202, 204 in their outwardly angled, relaxed states, or perhaps urged even yet further outwardly, cord continuous loop operator 154 is passed between heads 218, 220 into the open area having heads 218, 220 there above and mounting blocks 208, 210 there below. Arms 202, 204 are then urged toward one another so that heads 218, 220 slide past one another. One-way channels 230, 232 will then overlie one another, and cord continuous loop operator 154 is pulled into the then overlying one-way channels 230, 232, as depicted in FIG. 19. Cord continuous loop operator 154 is pulled further and completely into apertures 222, 224. With projections 234, 236 angling into apertures 222, 224, and the inner ends of one-way channels 230, 232 being narrower than the diameter of cord continuous loop operator 154, the cord is held securely in apertures 222, 224 and cannot pass back easily through one-way channels 230, 232.

With hold down device 200 installed on cord continuous loop operator 154, and inward pressure against arms 202, 204 subsequently being released, cord continuous loop operator 154 angles between the then misaligned apertures 222, 224 and against serrated portions 226, 228. Serrated portions 226, 228 engage and embed into cord continuous loop operator 154 such that hold down device 200 is held securely at its position along the length of cord continuous loop operator 154. Hold down device 200 securely engages cord continuous loop operator 154 and is not easily dislodged there from. Hold down device 200 renders the window covering inoperable in that the continuous loop operator 154 can be advanced only until hold down device 200 encounters head rail 152.

Hold down device 200 is mounted in its final position within window covering installation 150 after head rail 152 is installed in the window opening. Arms 202, 204 are urged toward one another so that mounting blocks 208, 210 engage one against the other. Heads 218, 220 slide past one another such that the heads overlie one another and apertures 222, 224 align. Mounting screw 216 is inserted through aligned holes 212, 214 and secured within a base 170 that can be a portion of a window frame on which window covering installation 150 is installed, a wall adjacent the window or some suitable structure nearby.

Fastening screw 216 to base 170, with screw 216 inserted from the outside arm 202, 204 through the inside arm 202, 204 draws the arms together and against base 170. Blocks 208, 210 are drawn against one another when heads 218, 220 are positioned adjacent one another, and apertures 222, 224 align. In this position, which may be considered a "closed" position of hold down device 200, serrated portions 226, 228 are no longer exposed, each being covered along one side by solid portions of the now adjacent head 218 or head 220. Accordingly, cord continuous loop operator 154 can slide freely through aligned apertures 222, 224 without catching on serrated portions 226, 228. The position at which hold down device 200 is mounted is such as to hold cord continuous loop operator 154 in a relatively taut condition, away from projections 234, 236. With hold down device 200 thus installed, apertures 222, 224 aligned one with the other and serrated portions 226, 228 no longer exposed, cord continuous loop operator 154 can rotate freely through hold down device 200 for adjusting shade panel 156 by operating apparatus within head rail 152 well known to those skilled in the art.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A hold down device for a continuous loop operator in a window covering installation, said hold down device comprising:

a first arm and a second arm connected to one another by a connecting web forming a biased connection between the arms, said connecting web enabling resisted movement of said first and second arms toward one another;

a first head provided at an end of said first arm distal the connecting web, a second head provided at an end of said second arm distal the connecting web, said first and second arms unconnected at the distal ends, said first head defining a first aperture, and said second head defining a second apertures, said first aperture extending transverse to said first arm, and said second aperture extending transverse to said second arm;

engaging means in said apertures for engaging a continuous loop operator extending through said first and second apertures;

a first mounting aperture defined by said first arm; and a second mounting aperture defined by said second arm, wherein in response to the hold down device being in a first configuration, the first and second apertures are not in alignment, and the first and second mounting apertures are not in alignment, and wherein in response to the hold down device being in a second configuration, the first and second apertures are in alignment, and the first and second mounting apertures are in alignment.

2. The hold down device of claim 1, said engaging means including notches in said apertures configured to receive and engage a bead chain.

3. The hold down device of claim 2, including depressions surrounding said notches.

4. The hold down device of claim 1, said first arm defining a first mounting block, and said second arm defining a second mounting block, wherein in the first configuration the first and second mounting blocks are not in contact, and wherein in the second configuration the first and second mounting blocks are in contact.

5. The hold down device of claim 1, said first and second heads being offset relative to one another to slide past one another, and said apertures aligning one with the other with said first and second heads overlying one another.

6. The hold down device of claim 5, said engaging means including notches in said apertures configured to receive and engage a bead chain.

7. The hold down device of claim 5, said engaging means including notches in said apertures and depressions surrounding said notches configured to receive and engage a bead chain.

8. The hold down device of claim 5, said engaging means including serrated portions projecting into said apertures and configured to engage a cord.

9. The hold down device of claim 5, said first and second heads including channels extending into said apertures.

10. The hold down device of claim 9, said channels being narrower adjacent said apertures and wider at ends thereof remote from said apertures.

11. The hold down device of claim 10, said channels including projections at opposite sides thereof, said projections extending angularly into said apertures.

12. The hold down device of claim 1, said engaging means including serrated portions projecting into said apertures and configured to engage a cord.

13. The hold down device of claim 1, said first and second heads including channels extending into said apertures.

14. The hold down device of claim 13, said channels being narrower adjacent said apertures and wider at ends thereof remote from said apertures.

15. The hold down device of claim 14, said channels including projections at opposite sides thereof, said projections extending angularly into said apertures.

16. A hold down device for a continuous loop operator in a window covering installation, said hold down device comprising:

a body including a first arm and a second arm connected to one another by a connecting web at a first end of each arm forming a biased resilient connection between said arms, said connecting web yieldably resisting movement of said arms toward one another;

a first head and a second head provided at a second end of each arm, the second ends being distal to the first ends, said first and second arms being detached at the second ends, said first head defining a first aperture and said second head defining a second aperture, said first and second apertures each extending in a direction that does not intersect the connecting web;

a first engaging means in said first aperture and a second engaging means in said second aperture, the first and second engaging means configured to engage a continuous loop operator extending through said first and second apertures;

a first mounting aperture defined by said first arm; and a second mounting aperture defined by said second arm, said connecting web urging said first and second arms toward a first configuration in which said first and second apertures are misaligned, and said first and second mounting apertures are misaligned, wherein in response to the connecting web being adjusted to a second configuration in which said first and second apertures are aligned, said first and second mounting apertures are aligned.

17. The hold down device of claim 16, said engaging means including notches in said apertures configured to receive and engage a bead chain.

18. The hold down device of claim 17, including depressions surrounding said notches.

19. The hold down device of claim 16, said first and second engaging means being serrated portions projecting into said apertures and configured to engage a cord.

20. The hold down device of claim 16, said first and second heads defining first and second channels extending into said first and second apertures.

21. The hold down device of claim 20, said first and second channels being narrower adjacent said first and second apertures and wider at ends thereof remote from said first and second apertures.

22. The hold down device of claim 21, said first and second channels each including projections at opposite sides thereof, said projections extending angularly into said first and second apertures.

23. The hold down device of claim 4, wherein the first mounting block is offset from the first mounting aperture, and the second mounting block is offset from the second mounting aperture.

* * * * *